US006062304A

United States Patent [19]

Kremer et al.

[11] Patent Number: 6,062,304

[45] Date of Patent: May 16, 2000

[54] HEAT EXCHANGER FOR A WATER-COOLED INTERNAL COMBUSTION ENGINE

[75] Inventors: Adolf Kremer, Remseck; Thomas Kettner, Stuttgart, both of Germany

[73] Assignee: Daimler Chrysler A.G., Stuttgart, Germany

[21] Appl. No.: 09/085,537

[22] Filed: May 27, 1998

[30] Foreign Application Priority Data

May 28, 1997 [DE] Germany ..... 197 22 256

[51] Int. Cl.[7] ..... F28D 7/10

[52] U.S. Cl. ..... 165/140; 165/139; 165/157

[58] Field of Search ..... 165/139, 140, 165/157

[56] References Cited

U.S. PATENT DOCUMENTS

| | | | |
|---|---|---|---|
| 631,426 | 8/1899 | Lanphear | 165/140 |
| 1,139,081 | 5/1915 | Stone | 165/140 |
| 2,003,744 | 6/1935 | Flockhart | 165/140 X |
| 2,354,932 | 8/1944 | Walker et al. | 165/140 X |
| 2,451,398 | 10/1948 | Marquette | 165/140 X |
| 2,731,239 | 1/1956 | Andersen | 165/140 X |
| 3,280,899 | 10/1966 | Brasie | 165/140 |
| 4,685,430 | 8/1987 | Ap . | |

FOREIGN PATENT DOCUMENTS

| | | |
|---|---|---|
| 2 730 011 | 8/1996 | France . |
| 35 08 240 | 9/1986 | Germany . |
| 2 065 859 | 7/1981 | United Kingdom . |
| 2 097 115 | 10/1982 | United Kingdom . |

*Primary Examiner*—Allen Flanigan
*Attorney, Agent, or Firm*—Klaus J. Bach

[57] ABSTRACT

A heat exchanger for a water-cooled internal combustion engine having a lubricant cooling system and an exhaust gas recirculation system includes a housing with cooling water inlet and outlet stubs by way of which cooling water is conducted through the interior of the housing, and a lubricant cooler is formed in the housing and separated from the cooling water space by a zigzag-shaped intermediate wall and a recirculated exhaust gas cooler is disposed in the housing in heat exchange relation with the cooling water flowing through the housing.

7 Claims, 2 Drawing Sheets

HEAT EXCHANGER FOR A WATER-COOLED INTERNAL COMBUSTION ENGINE

BACKGROUND OF THE INVENTION

The invention resides in a heat exchanger for a water-cooled internal combustion engine with lubricant cooling and external exhaust gas recirculation.

In order to comply with emission requirements, exhaust gas is frequently recirculated to the fresh air/fuel mixture- or, respectively, the intake air flow of the engine in order to lower the combustion temperature and, as a result, the $NO_x$ content of the exhaust gas. The $NO_x$ content can be further reduced if the recirculated exhaust gas is cooled. However, such cooling poses some problems as it requires a corresponding cooler which has to be accommodated in the engine compartment where there is little space in today's motor vehicles especially if a lubricant cooler is already present as it is often the case in connection with powerful internal combustion engine.

SUMMARY OF THE INVENTION

A heat exchanger for a water-cooled internal combustion engine having a lubricant cooling system and an exhaust gas recirculation system includes a housing with cooling water inlet and outlet stubs by way of which cooling water is conducted through the interior of the housing, and a lubricant cooler is formed in the housing and separated from the cooling water space by a zigzag-shaped intermediate wall and a recirculated exhaust gas cooler is disposed in the housing in heat exchange relation with the cooling water flowing through housing.

With the arrangement according to the invention, a compact heat exchanger is provided, which provides for cooling of the lubricant and, at the same time, of the recirculated exhaust gas, which can be accommodated in a very small space in the engine compartment of a motor vehicle.

The exhaust gas cooler may include a tube bundle which extends in the cooler housing between an inlet manifold in communication with an inlet pipe and an exhaust manifold in communication with an outlet pipe. The lubricant cooler may be formed by a part of the interior of the heat exchanger which is limited by the wall of the heat exchanger housing and an intermediate wall and which includes lubricant inlet and outlet nozzles. To increase the heat exchange surface area, the intermediate wall may have a meander or zigzag shape.

To simplify manufacture, the housing may comprise a top and a bottom part wherein the intermediate wall delimiting the lubricant cooler is preferably arranged in the bottom part and the exhaust gas cooler, that is, the tube bundle with the inlet and outlet manifolds is preferably arranged in the top part.

The cooling water connections may be formed by stub portions consisting of projections which are semicircular in cross-section and extend from the bottom and the top parts of the housing and which cooperate when the top and bottom housing parts are joined to form tubular inlet and outlet stubs. The intermediate wall may be positioned in the bottom housing part by projections, which are partially circular in cross-section and extend into the cooling water stubs. In the bottom part of the housing, the intermediate wall is sealingly connected to the bottom housing wall for example by brazing.

A cooling water inlet connection may be provided at one front end and two opposite water outlets may be provided at the side walls of the housing.

In order to achieve an intense cooling of the recirculated exhaust gas, the exhaust gas flow through the exhaust gas cooler should be in a counter-current relationship with the cooling water flow in the interior of the heat exchanger housing.

An embodiment of the invention will be described below with reference to the drawings.

DESCRIPTION OF A PREFERRED EMBODIMENT

Figure 1:
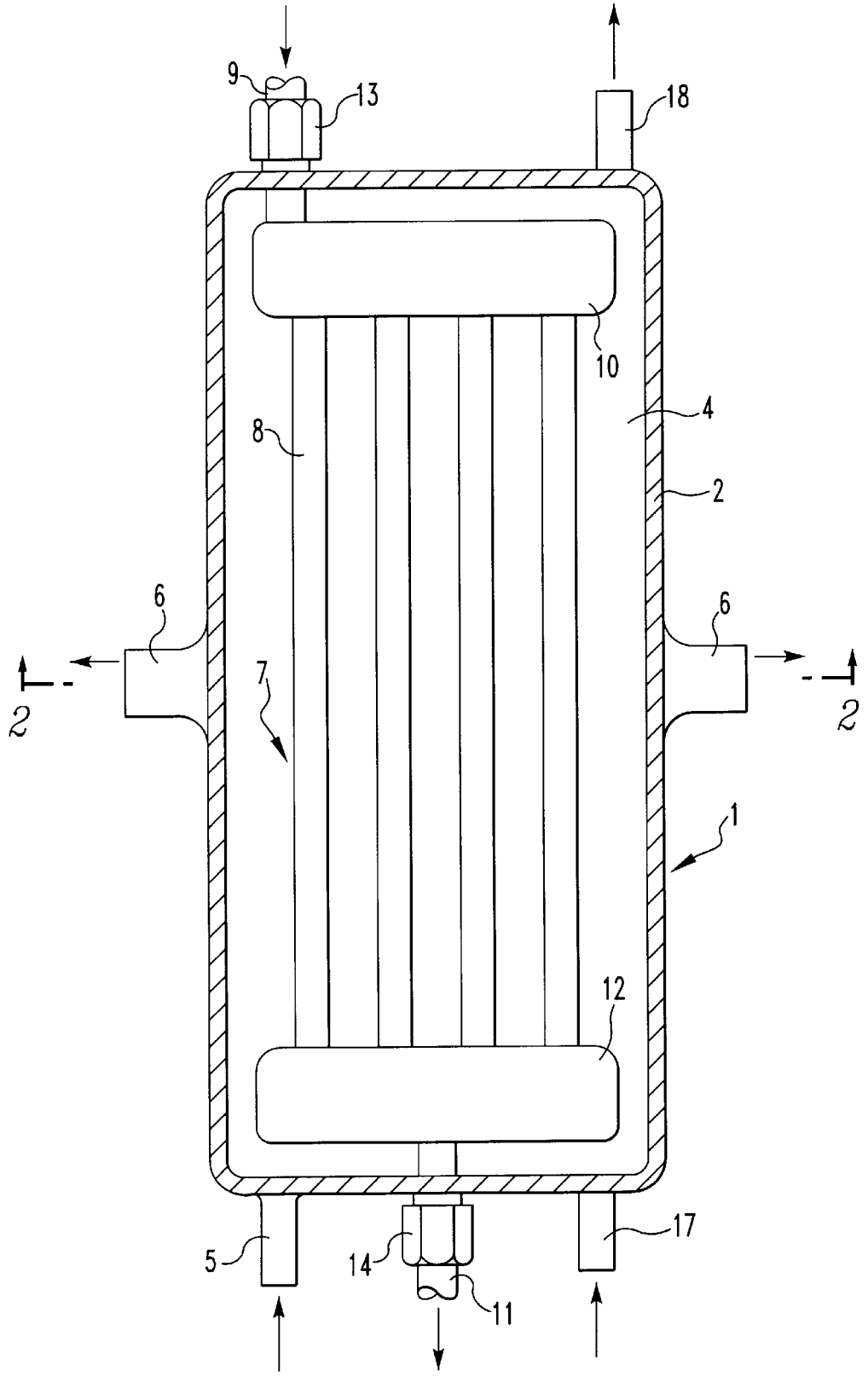
FIG. 1 is a longitudinal cross-sectional view of the heat exchanger taken along line 1—1 of FIG. 2.

As shown in the figures, the heat exchanger includes a housing 1 consisting of a top part 2 and a bottom part 3, which are interconnected along a separation plane 19 and delimit an interior space 4. A cooling water inlet stub 5 is provided at one front end of the housing so as to be in communication with the interior space 4 and cooling water inlet stubs 6 are provided at opposite side walls of the heat exchanger housing 1. The top part 2 of the heat exchanger housing 1 includes a cooler 7 for the recirculated exhaust gas. The cooler 7 is formed by a tube bundle 8, which extends between an inlet manifold 10 connected to an exhaust gas inlet pipe 9 and an outlet manifold 12 connected to an outlet pipe 11. The inlet and outlet pipes 9 and 11 are connected to the housing 1 by way of heat resistant stuffing boxes with cap screws 13 and 14 providing a gas-tight sealing structure.

In the interior space 4, there is further provided a lubricant cooler, which is formed by a portion 15 of the interior space 4 delimited by the wall of the bottom part 3 of the housing 1 and an intermediate wall 16. In order to increase the heat exchange surface area, the intermediate wall 16 has a meander or zigzag shape. The portion 15 of the interior space 4, which forms the lubricant cooler is in communication with a lubricant inlet stub 17 and a lubricant outlet stub 18. For clarity reasons, the intermediate wall 16 is not depicted in FIG. 1. It extends over the whole area of the interior space 4.

Figure 2:
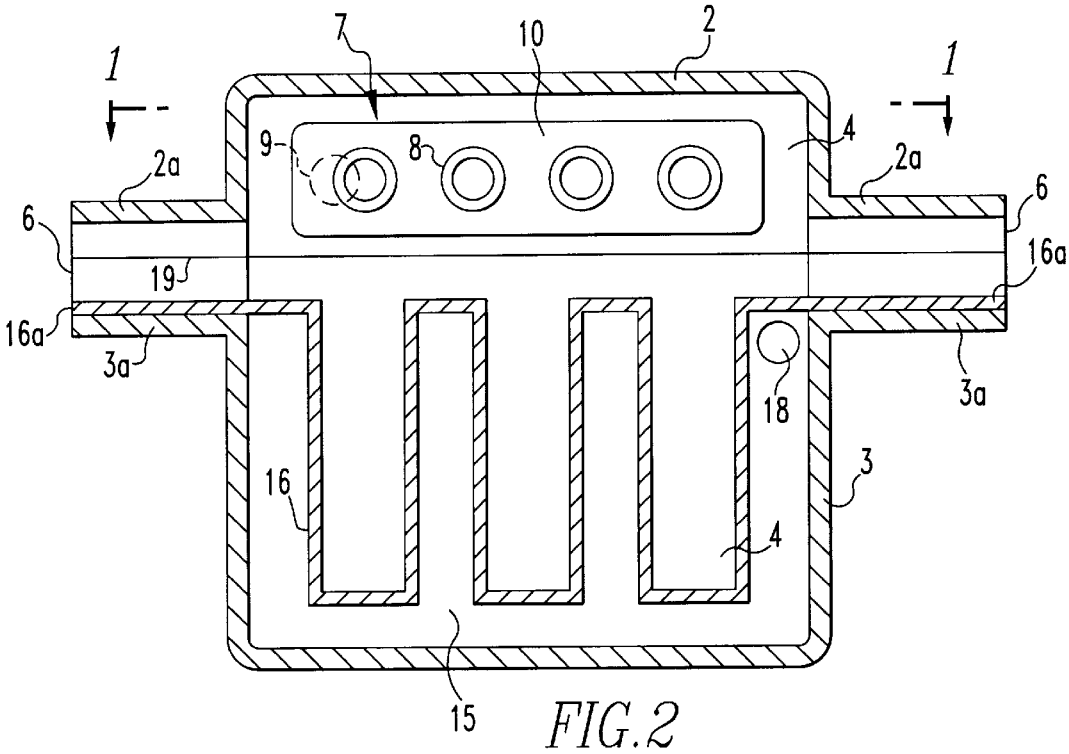
FIG. 2 is a cross-sectional view of the heat exchanger taken along line 2—2 of FIG. 1.

The cooling water inlet and outlet stubs 5 and 6 are formed by projections of the top part 2 and the bottom part 3, which projections are semi-circular in cross-section and complement one another to form the tubular stubs 5 and 6 when the top and bottom parts 2 and 3 are joined along the separation plane 19 as it is shown in FIG. 2 for the outlet stub 6.

The intermediate wall 16 also includes projections 16*a*, which are semicircular in cross-section and project into the coolant outlet stubs 6 as it is shown in FIG. 2. In this way, the intermediate wall is properly positioned during assembly of the heat exchanger. Upon assembly, the intermediate wall 16 is joined with the heat exchanger housing wall 3 (bottom part) for example by brazing.

In the arrangement as shown in FIG. 1, the cooling water flows through the housing 1 and the lubricant flows through the housing portion 15 from the bottom to the top whereas the recirculated exhaust gas flows through the cooler 7 from the top to the bottom, that is, in a counter-current relationship with respect to the cooling water. As a result, the recirculated exhaust gas is intensely cooled.

Both the cooling of the exhaust gas and the cooling of the lubricant are achieved with a single relatively small and inexpensive heat exchanger.

What is claimed is:

1. A heat exchanger for a water-cooled internal combustion engine including a lubricant cooling system and an exhaust gas recirculation system, comprising:

a housing with walls defining an interior space and having cooling water inlet and outlet stubs, a lubricant cooler formed in said housing by a part of the walls of said housing and an intermediate wall, and being in communication with lubricant inlet and a lubricant outlet stubs disposed on said housing walls and a recirculated exhaust gas cooler disposed in said housing in heat exchange relationship with cooling water in said interior space.

2. A heat exchanger according to claim 1, wherein said recirculated exhaust gas cooler is formed by a tube bundle extending between an inlet manifold connected to an inlet pipe and an outlet manifold connected to an outlet pipe, said inlet and outlet manifold being disposed at opposite ends of said housing such that said tube bundle extends through said housing.

3. A heat exchanger according to claim 1, wherein said intermediate wall has a meander or zigzag shape.

4. A heat exchanger according to claim 1, wherein said housing comprises a top and a bottom part and said intermediate wall delimiting said lubricant cooler is disposed in said bottom part and said recirculated exhaust gas cooler is disposed in said top part.

5. A heat exchanger according to claim 4, wherein said cooling water inlet and outlet stubs are formed by housing projections, which have a semi-circular cross-section and extend from said housing top and bottom parts and which are joined when the housing top and bottom parts are joined.

6. A heat exchanger according to claim 4, wherein said intermediate wall has projection, which are partially circular in cross-section and which extends into said semi-circular projection of said housing bottom part for fixing said intermediate wall in said housing bottom part.

7. A heat exchanger according to claim 1, wherein said coolant inlet stub is formed on a front wall of said housing and two coolant outlet stubs are provided opposite each other at the opposite side walls of the housing.

* * * * *